US012245689B1

(12) United States Patent
Meehan

(10) Patent No.: US 12,245,689 B1
(45) Date of Patent: Mar. 11, 2025

(54) ORGANIZATIONAL SYSTEM

(71) Applicant: James Meehan, Denver, CO (US)

(72) Inventor: James Meehan, Denver, CO (US)

( * ) Notice: Subject to any disclaimer, the term of this patent is extended or adjusted under 35 U.S.C. 154(b) by 0 days.

(21) Appl. No.: 18/949,843

(22) Filed: Nov. 15, 2024

Related U.S. Application Data

(60) Provisional application No. 63/607,692, filed on Dec. 8, 2023.

(51) Int. Cl.
*A47B 57/34* (2006.01)
*A47B 57/40* (2006.01)
*A47F 5/08* (2006.01)

(52) U.S. Cl.
CPC ..... *A47B 57/34* (2013.01); *A47B 57/404* (2013.01); *A47F 5/0815* (2013.01)

(58) Field of Classification Search
CPC ..... A47B 57/34; A47B 57/404; A47B 57/16; A47B 57/40; A47B 57/42; A47B 57/425; A47B 96/1466; A47B 96/1475; A47F 5/08; A47F 5/0807; A47F 5/0815; A47F 5/0846; A47F 5/0853
USPC .... 211/10, 106.01, 106, 94.01, 90.01, 90.02, 211/90.04, 193; 248/222.51, 223.41, 248/224.8, 225.11, 225.21
See application file for complete search history.

(56) References Cited

U.S. PATENT DOCUMENTS 1,938,370 A * 12/1933 Bodkin ..... A47F 5/0807 248/222.51
3,306,564 A * 2/1967 Nickel ..... A47F 5/0815 248/222.51
3,352,428 A * 11/1967 Sak ..... A47B 96/06 211/187
3,482,706 A * 12/1969 Stewart ..... A47B 57/42 52/36.6
3,516,552 A * 6/1970 Salava ..... A47G 29/06 248/222.51
3,844,231 A * 10/1974 Peacock ..... B32B 21/08 108/107
4,461,443 A * 7/1984 Dauman ..... A47F 5/0846 211/87.01
4,932,538 A * 6/1990 Gambello ..... A47F 5/0846 248/222.51
5,477,969 A * 12/1995 Beeskau ..... A47F 5/0815 248/225.11

(Continued)

*Primary Examiner* — Jennifer E. Novosad

(74) *Attorney, Agent, or Firm* — QuickPatents; Kevin Prince

(57) ABSTRACT

The organization system utilizes a base panel with vertical slots that engage supports to hold storage accessories. The base panel has a front, rear, and edges, and can be wall-mounted or free-standing. The slots feature alternating through-portions and blocked-portions. Spacers on the rear provide a predetermined distance from the mounting surface for wall-mounted versions. The supports have opposing sides, top and bottom ends, and front and rear terminations with upper and lower hooks. These hooks cooperate to traverse slot through-portions and hook around blocked-portions to firmly seat supports. Various loads like shelves, racks, bars, and hooks mount onto support top ends. The base panel and supports can be made from materials such as metal, plastic, or wood. A metallic strip may be added for additional support with heavy loads. The system allows easy rearrangement to suit changing storage needs.

18 Claims, 7 Drawing Sheets

(56) References Cited

U.S. PATENT DOCUMENTS 5,595,309 A * 1/1997 Bauer ..... A47F 5/0815 248/220.31
5,803,274 A * 9/1998 Scheveloff ..... A47F 5/0815 52/36.6
5,927,840 A * 7/1999 Bzowski ..... E06B 7/28 211/88.01
6,491,172 B2 * 12/2002 Chance ..... A47F 5/0846 248/222.51
6,591,995 B1 * 7/2003 Grove ..... A47F 5/0815 211/87.01
6,701,678 B1 * 3/2004 Skov ..... E04H 1/1205 52/79.9
6,772,889 B2 * 8/2004 Moceri ..... A47B 46/00 211/36
6,929,131 B1 * 8/2005 Landi ..... A47F 5/0846 248/222.51
7,003,863 B2 * 2/2006 Skov ..... A47F 5/0815 52/36.5
7,984,815 B2 * 7/2011 Lynch ..... A47F 5/0018 211/186
9,142,150 B2 * 9/2015 Logan ..... G09F 7/10
9,422,960 B2 * 8/2016 Lortie ..... F16B 12/14
10,165,872 B2 * 1/2019 Jones ..... A47F 5/0823
10,405,676 B1 * 9/2019 Underwood ..... A47F 5/06
2003/0052073 A1 * 3/2003 Dix ..... A47G 7/044 211/90.02
2006/0254996 A1 * 11/2006 McAfee ..... A47B 57/10 211/90.02
2007/0141946 A1 * 6/2007 Sorensen ..... A47F 5/0815 446/118
2010/0193455 A1 * 8/2010 Russell ..... A47B 81/064 211/90.04
2010/0270246 A1 * 10/2010 Rodriguez ..... A47B 96/16 211/119.004
2015/0260335 A1 * 9/2015 Lortie ..... F16B 12/14 248/223.41
2016/0135613 A1 * 5/2016 Jones ..... A47K 10/185 211/85.5

* cited by examiner

ORGANIZATIONAL SYSTEM

CROSS REFERENCE TO RELATED APPLICATIONS

This application claims the benefit of U.S. Provisional Patent Application 63/607,692, filed on Dec. 8, 2023, and incorporated herein by reference.

STATEMENT REGARDING FEDERALLY SPONSORED RESEARCH AND DEVELOPMENT

Not Applicable.

FIELD OF THE INVENTION

This invention relates to organization and storage systems, and more particularly to an easy to assemble and reconfigurable shelving organization system.

BACKGROUND

Existing shelving and organization systems have several drawbacks. They are typically heavy steel constructions that require tools and hardware for assembly. This makes them cumbersome to put together and difficult to transport. The steel also makes them prone to rusting and corrosion over time. These heavy systems are expensive to produce and purchase, making them impractical for regular residential use. Additionally, the stationary shelves and components lack adaptability to rearrange and organize different items as storage needs change.

Therefore, there is a need for a device that would provide an improved organization system that is lightweight and easy to install, as well as easy to rearrange to suit changing storage needs. The needed system would deliver an affordable, adaptable system convenient for residential use, with options for both wall-mounted and free-standing configurations. Such a needed invention would provide versatility and flexibility compared to heavy stationary steel shelving units prevalent in the prior art. The present invention accomplishes these objectives.

SUMMARY OF THE INVENTION

The present device is an organization system supported on a vertical surface such as a wall, post, or furniture, or alternatively configured as a free-standing unit on a horizontal surface. It comprises a base panel having a front side, rear side, and at least one peripheral edge. The base panel, which can be made from materials such as plywood, metal, plastic, or stone, includes several parallel vertical slots (or horizontal slots in some embodiments). Each slot has through portions traversing completely through the base panel and alternating with blocked portions that are cut partially through the base panel from the front side. The through portions and blocked portions of each slot are co-aligned.

The base panel also includes at least one spacer fixed to its rear side to space it away from the vertical surface by a predetermined distance. There are several supports included, each with two opposing sides, a top end, bottom end, front end, and rear end terminating in upper and lower hooks. The supports, which can be made from materials such as metal, plastic, or wood, have a thickness less than that of the slots. The hooks are configured to cooperate with the through portions and blocked portions of the slots to traverse and hook around them to support a load. The hooks extend past the rear of the base panel by no more than the predetermined distance set by the spacers.

The load can be various items like a shelf, clothes bar, dual shelf rack, or a hook. The shelf may be supported by two of the supports engaged in two separate slots each. There may also be a metallic strip fixed at the blocked portions of each slot so that when the supports are fully engaged, their upper hooks contact the metallic strip for additional strength with heavy loads.

The vertical slots can be spaced apart from each other by predetermined distances so that shelves and racks designed to those spacing multiples can be easily supported. This allows for an adaptable organization system that can rearrange components and add accessories like shelves, racks, and hooks as needed.

In use, with the base panel supported on and spaced from the vertical surface (or in an upright position for the free-standing version), each support is tilted so the top hook goes through one slot's through portion. The support is then rotated and slid down so both hooks engage a blocked portion of the slot to firmly seat the support, with the load rested on top of the support. The supports can be moved to different slots and blocked portions to rearrange the system.

The present invention provides an improved organization system that is lightweight and easy to install, as well as rearrange to suit changing storage needs. The system utilizes a base panel with slots to engage tool-free supports and hooks that can hold various accessory loads. The base panel spacers allow firmly seating the supports while keeping them from contacting the mounting surface. Overall, the present invention delivers an affordable, adaptable system convenient for residential use. It provides versatility and flexibility compared to heavy stationary steel shelving units prevalent in the prior art.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
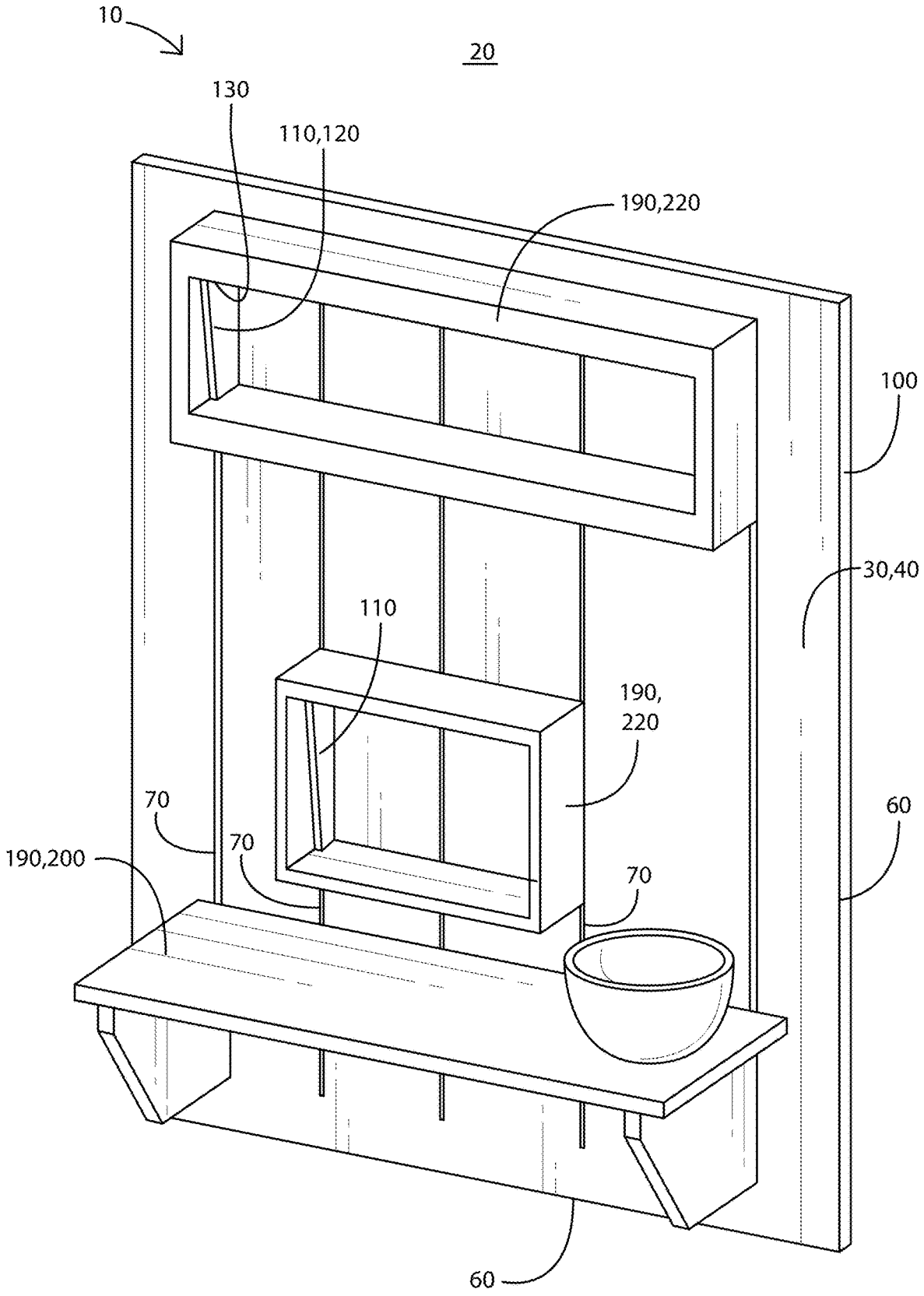
FIG. 1 is a front perspective view of one embodiment of the invention.
Figure 2:
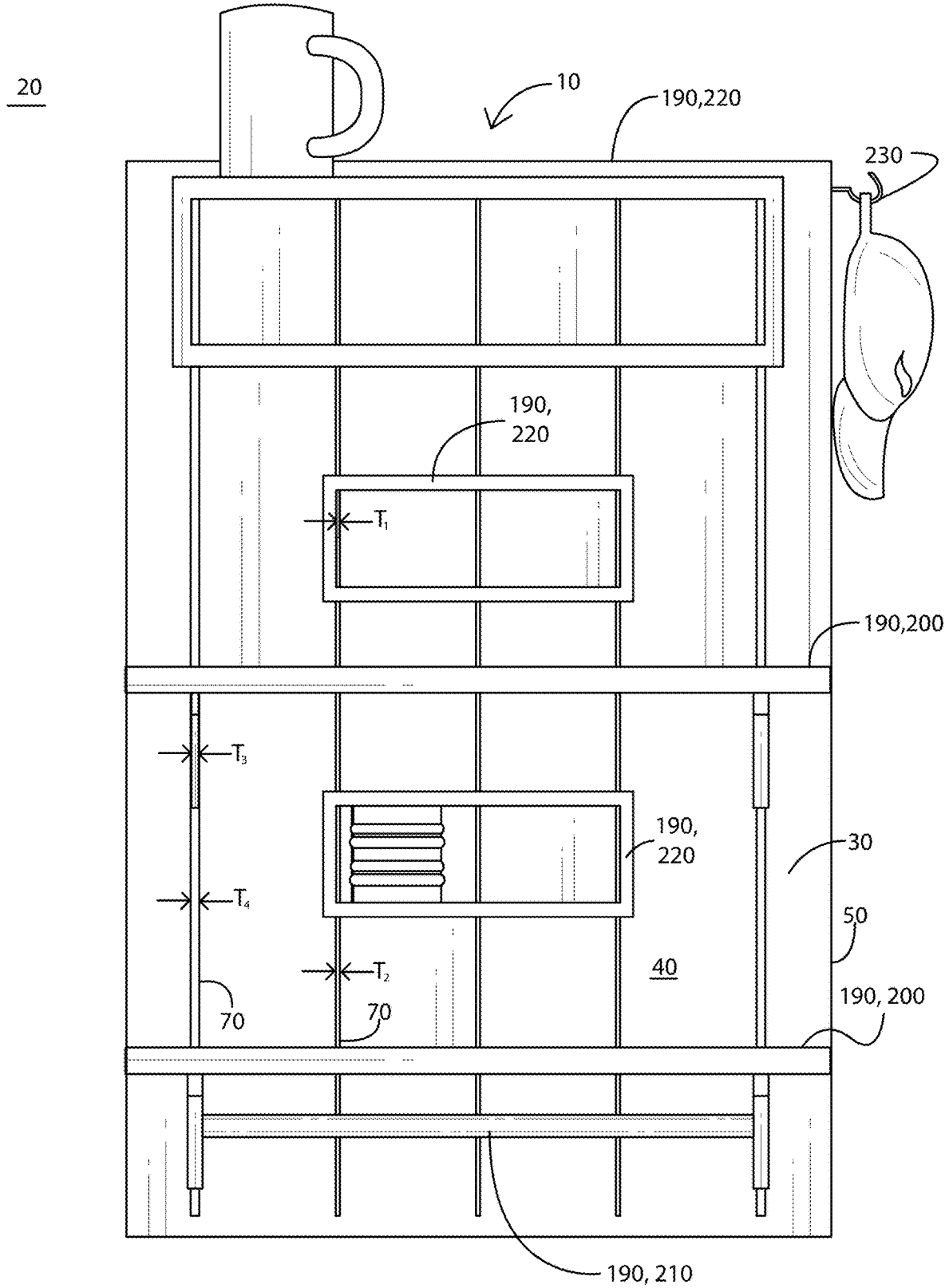
FIG. 2 is a front elevational view thereof, illustrated as in-use and holding several loads.
Figure 3:
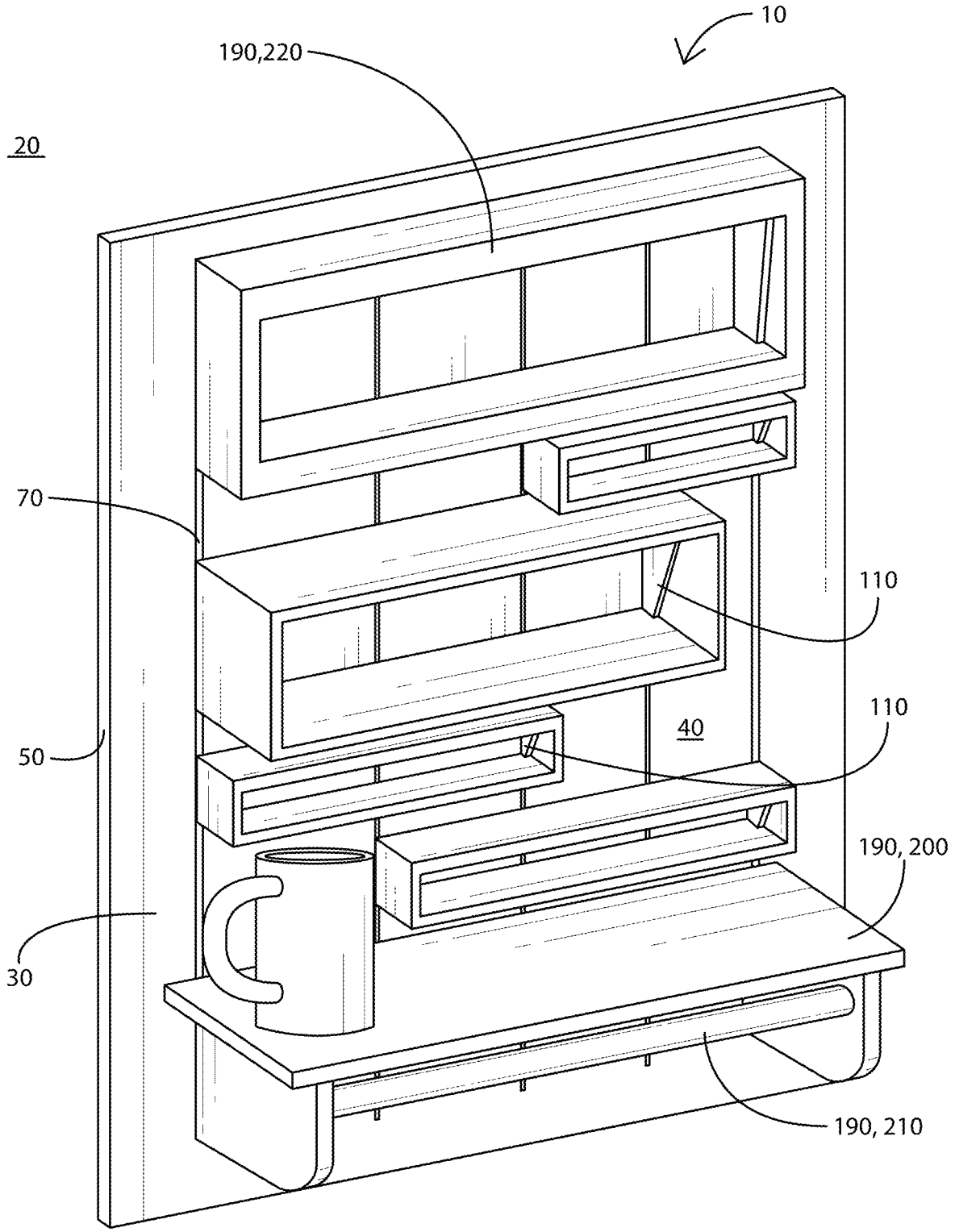
FIG. 3 is a front perspective view of an alternate embodiment of the invention, illustrating a plurality of dual shelf racks and a clothes bar supported by a base panel and a plurality of supports.
Figure 4:
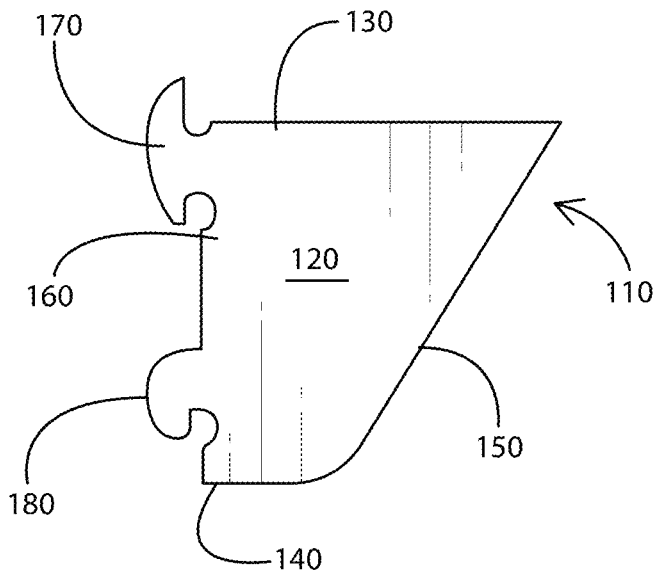
FIG. 4 is a side elevational view of several of the supports of the invention.
Figure 5:
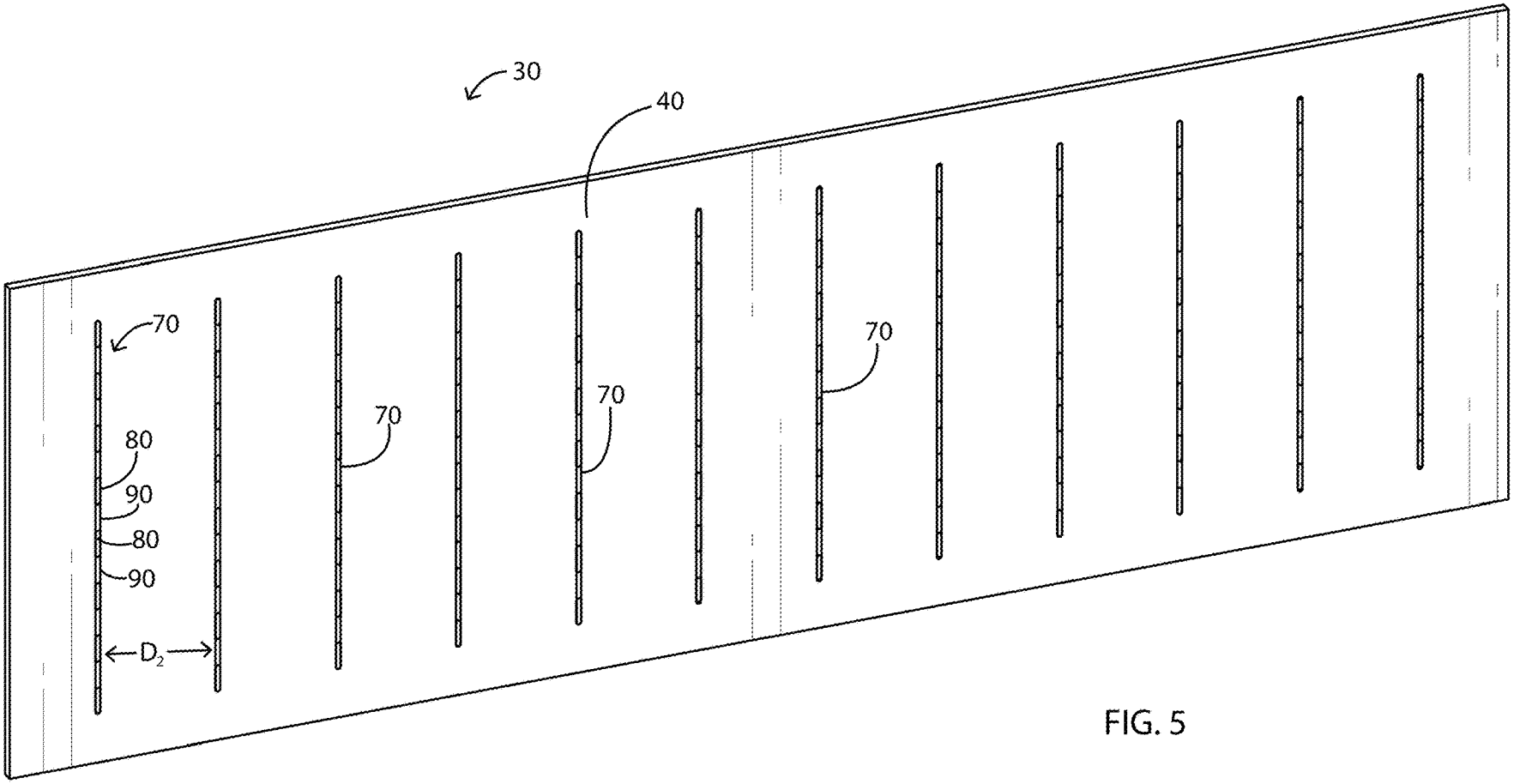
FIG. 5 is a front perspective view of the base panel, illustrating a plurality of parallel, evenly-spaced vertical slots.
Figure 6:
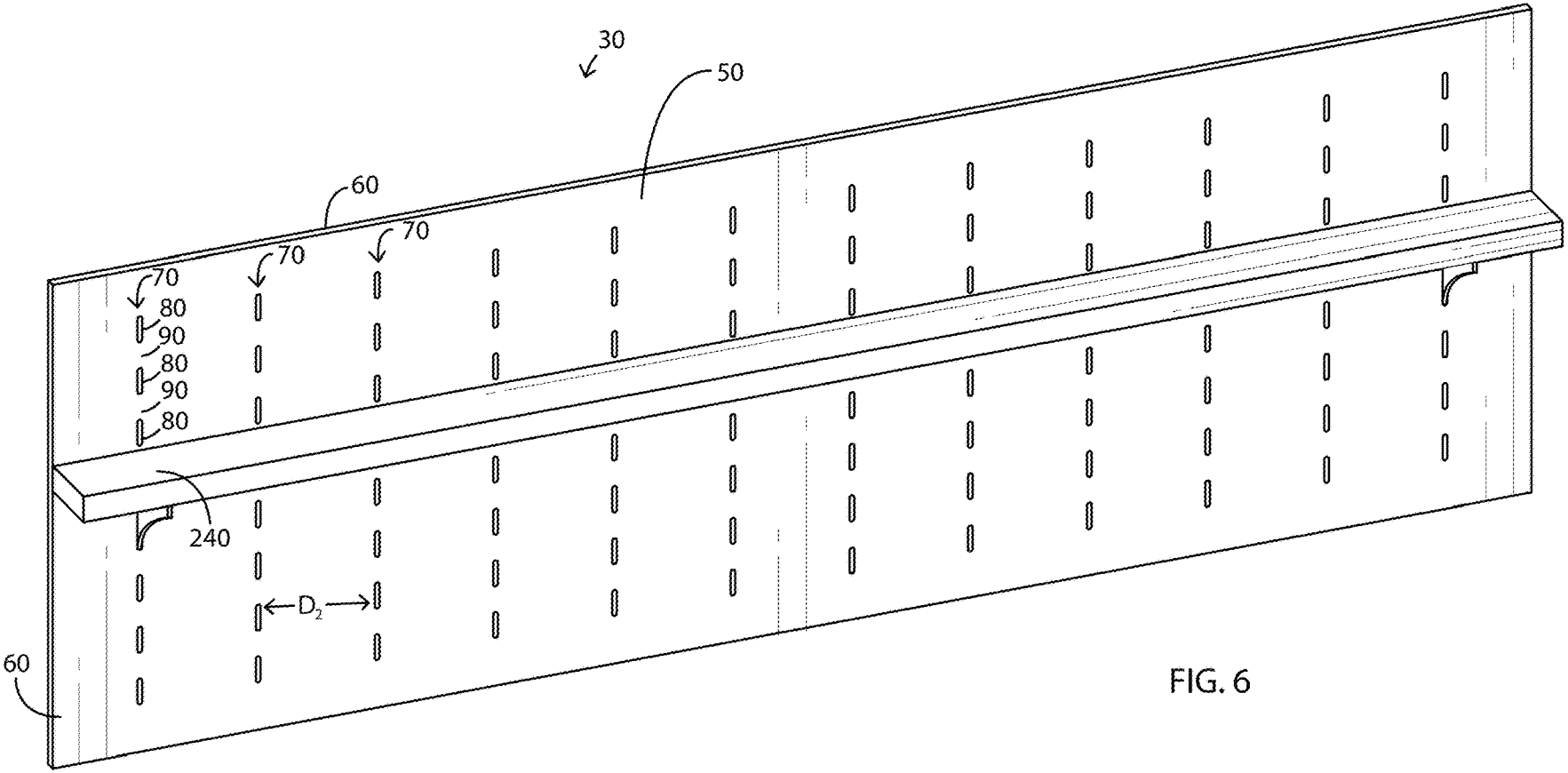
FIG. 6 is a rear perspective view of the base panel of FIG. 5.

FIGS. 1-3 illustrate an organization system 10 supported on a vertical surface 20, such as a wall surface, a post, a piece of furniture, or the like. A base panel 30 has a front side 40, a rear side 50, and at least one peripheral edge 60. The base panel 30 may be rectangular as illustrated in the figures, oval, hexagonal, or any other desired shape having a sufficient area for accommodating the vertical slots 70.

The base panel 30 further includes a plurality of parallel vertical slots 70, each slot 70 having through portions 80 traversing completely through the base panel 30 from the front side 40 to the rear side 50. The through portions 80 alternate with the blocked portions 90, which are cut partially through the base panel 30 from the front side 40. The through portions 80 of each slot 70 are mutually co-aligned, as are the blocked portions 90 of each slot 70.

The base panel 30 can be made from materials such as plywood, metal, plastic, stone, or the like. The base panel 30 includes at least one spacer 100 fixed to the rear side 50 and adapted for spacing the base panel 30 away from the vertical surface 20 by a predetermined distance $D_1$.

A plurality of supports 110 each have two opposing sides 120, a top end 130, a bottom end 140, a front end 150, and a rear end 160 terminating at an upper hook 170 and a lower hook 180. The support 110 has a thickness $T_1$ between the two opposing sides 120 less than a thickness $T_2$ of each vertical slot 70 of the base panel 30. For example, each slot 70 may be 3/16 of an inch thick, and each support 110 may be 1/8 of an inch thick. The supports 110 can be made from materials such as metal, plastic, wood, or the like.

The upper hook 170 and lower hook 180 are configured to cooperate with the through portions 80 and the blocked portions 90 of the vertical slot 70. The upper hook 170 first traverses one of the through portions 80 and hooks around the adjacent blocked portion 90 to support a load 190 on the top end 130 of the support 110. The upper hook 170 and lower hook 180 extend past the rear side 50 of the base panel 30 by no more than the predetermined distance $D_1$. The at least one spacer 100 prevents the upper hook 170 or the lower hook 180 from contacting the vertical surface 20.

The load 190 may include a shelf 200 that can be made from materials like wood, metal, plastic, glass, or the like. Such a shelf 200 may be supported by two of the supports 110 engaged in two separate slots 70 each.

The load 190 may include a clothes bar 210 for supporting hangers for clothing, or the like. Such a clothes bar 210 may be made of materials such as metal, wood, plastic, or the like.

The load 190 may include a dual shelf rack 220 supported by two of the supports 110. Such a dual shelf rack 220 may be constructed from materials like metal, plastic, wood, or the like.

The load 190 may include a hook 230 for hanging one or more items thereon. Such a hook 230 may be made of materials such as metal, plastic, wood, or the like.

A metallic strip 240 may be fixed with the rear side 50 of the base panel 30 at each blocked portion 90 of each slot 70. The metallic strip 240 can be made of aluminum, steel, or the like. When the supports 110 are fully engaged with the slots 70, at least the upper hook 170 of each support 110 contacts the metallic strip 240 for additional support and strength with heavy loads 190.

Preferably the at least one spacer 100 is a plurality of spacers 100 disposed along the peripheral edge 60 of the base panel 30 at the rear side 50 thereof. Further, each vertical slot 70 is preferably spaced a predetermined distance $D_2$ from each other vertical slot 70, such as five inches for example. The shelf 200 or the dual shelf rack 220 is then preferably configured to be a multiple of the predetermined distance $D_2$ such that the supports 110 are disposed proximate ends 205 of the shelf 200 or ends 225 of the dual shelf rack 220, for example.

In use, with the base panel 30 supported on the vertical surface 20 and spaced away from the vertical surface 20 by the predetermined distance $D_1$, each support 110 is tilted rearward so that the upper hook 170 traverses one of the vertical slots 70 at the through portion 80 and then rotated forward and slid downwardly in the slot 70 so that both the upper hook 170 and the lower hook 180 engage one of the blocked portions 90 of the slot 70 to firmly seat the support 110 within the slot 70, the load 190 then rested on the top end 130 of the support 110. The supports 110 may be moved to different slots 70 at different of the blocked portions 90 as desired to rearrange the organization system 10.

Figure 7:
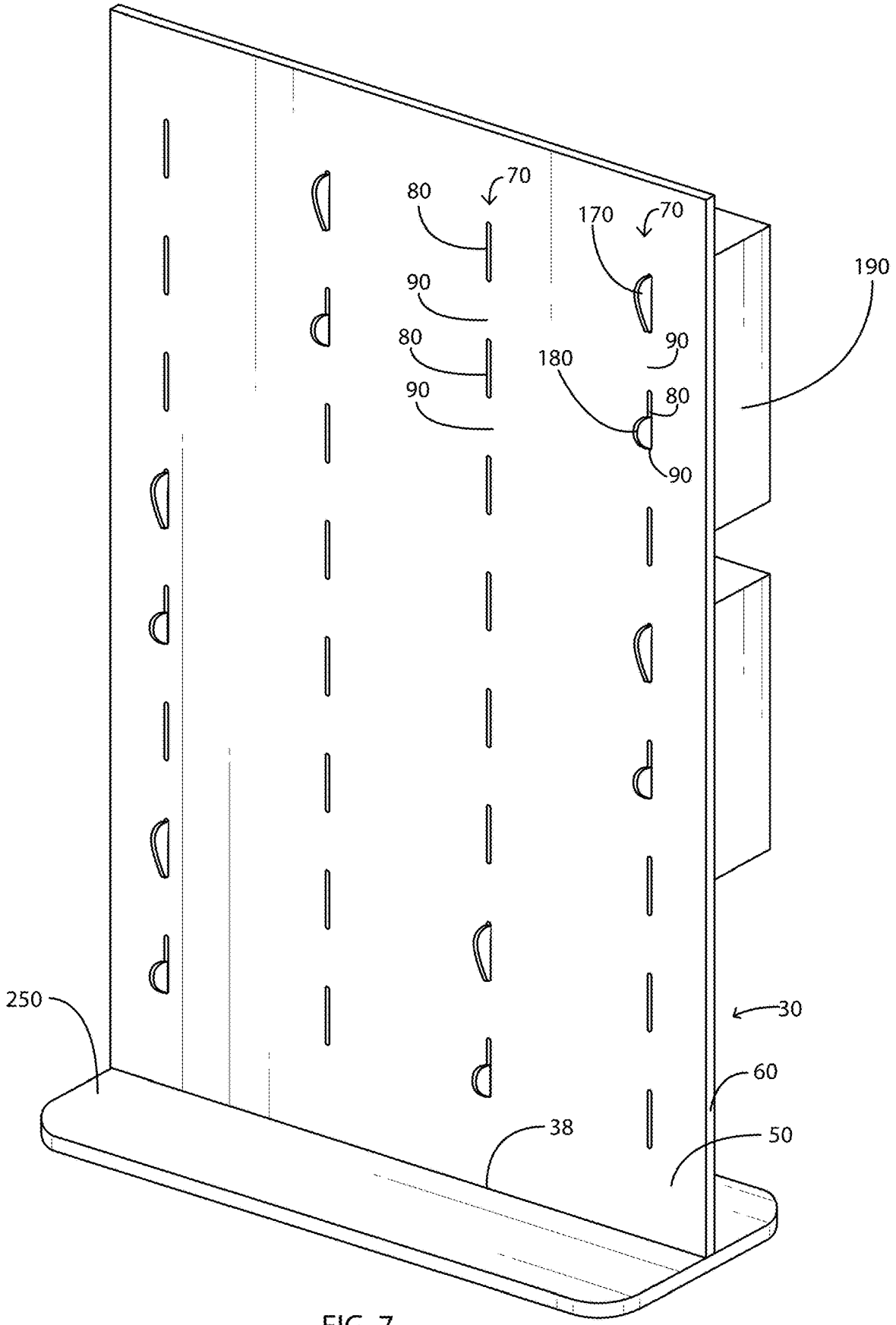
FIG. 7 is a rear perspective view of an alternate, free-standing embodiment of the invention.

FIG. 7 illustrates an alternate organization system 10 supported on a horizontal surface 25, such as a tabletop, countertop, floor, or the like. The base panel 30 includes a stand 250 fixed to a bottom side 32 for supporting the base panel 30 in an upright position on the horizontal surface 25. In such an embodiment, the slots 70 are oriented horizontally. The at least one spacer 100 is not necessary in this configuration, as the upper hook 170 and the lower hook 180 are free from any vertical surface obstructions.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filling the application to pursue such additional claim forms for other aspects of the invention.

What is claimed is:

1. An organization system supported on a vertical surface, comprising:

a base panel having a front side, a rear side, and at least one peripheral edge, the base panel further including a plurality of parallel vertical slots, each slot having through portions traversing completely through the base panel from the front side to the rear side, the through portions alternating with blocked portions cut partially through the base panel from the front side, the through portions of each slot mutually co-aligned and the blocked portions of each slot mutually co-aligned, the base panel including at least one spacer fixed to the rear side and adapted for spacing the base panel away from the vertical surface by a predetermined distance;

a plurality of supports each having two opposing sides, a top end, a bottom end, a front end, a rear end terminating at an upper hook and a lower hook, the support having a thickness between the two opposing sides less than a thickness of each vertical slot of the base panel, the upper hook and lower hook configured to cooperate with the through portions and the blocked portions of the vertical slot to traverse the through portions and hook around the blocked portions to support a load on the top end of the support, the upper hook and lower hook extending past the rear side of the base panel no more than the predetermined distance;

whereby with the base panel supported on the vertical surface and spaced away from the vertical surface by the predetermined distance, each support is tilted rearward so that the upper hook traverses one of the vertical slots at the through portion and then rotated forward and slid downwardly in the slot so that both the upper hook and the lower hook engage one of the blocked portions of the slot to firmly seat the support within the slot, the load then rested on the top surface of the support.

2. The organization system of claim 1 wherein the load includes a shelf supported by two of the supports, each of the supports being engaged with two separate of the vertical slots.

3. The organization system of claim 1 wherein the load includes a clothes bar supported by two of the supports, each of the supports being engaged with two separate of the vertical slots.

4. The organization system of claim 1 wherein the load includes a dual shelf rack supported by two of the supports, each of the supports being engaged with two separate of the vertical slots.

5. The organization system of claim 1 wherein the load includes at least one hook.

6. The organization system of claim 1 wherein the base panel is made from a plywood material.

7. The organization system of claim 1 wherein the base panel is made from a metallic material.

8. The organization system of claim 1 wherein the base panel is made from a plastic material.

9. The organization system of claim 1 further including a metallic strip fixed with the rear side of the base panel at each blocked portion of each slot, such that when the supports are fully engaged with the slots, at least the upper hook of each support contacts the metallic strip.

10. The organization system of claim 1 wherein the at least one spacer is a plurality of spacers disposed along the at least one peripheral edge of the base panel at the rear side thereof.

11. The organization system of claim 1 wherein each vertical slot is spaced a predetermined distance from each other vertical slot.

12. An organization system supported on a vertical surface, comprising:

a base panel having a front side, a rear side, and at least one peripheral edge, the base panel further including a plurality of parallel vertical slots, each slot having through portions traversing completely through the base panel from the front side to the rear side, the through portions alternating with blocked portions cut partially through the base panel from the front side, the through portions of each slot mutually co-aligned and the blocked portions of each slot mutually co-aligned, the base panel including at least one spacer fixed to the rear side and adapted for spacing the base panel away from the vertical surface by a predetermined distance;

a plurality of supports each having two opposing sides, a top end, a bottom end, a front end, a rear end terminating at an upper hook and a lower hook, the support having a thickness between the two opposing sides less than a thickness of each vertical slot of the base panel, the upper hook and lower hook configured to cooperate with the through portions and the blocked portions of the vertical slot to traverse the through portions and hook around the blocked portions to support a load on the top end of the support, the upper hook and lower hook extending past the rear side of the base panel no more than the predetermined distance;

whereby with the base panel supported on the vertical surface and spaced away from the vertical surface by the predetermined distance, each support is tilted rearward so that the upper hook traverses one of the vertical slots at the through portion and then rotated forward and slid downwardly in the slot so that both the upper hook and the lower hook engage one of the blocked portions of the slot to firmly seat the support within the slot, the load then rested on the top surface of the support;

wherein the load includes a shelf supported by two of the supports, each of the supports being engaged with two separate of the vertical slots;

wherein the base panel is made from a plastic material;

further including a metallic strip fixed with the rear side of the base panel at each blocked portion of each slot, such that when the supports are fully engaged with the slots, at least the upper hook of each support contacts the metallic strip; wherein the at least one spacer is a plurality of spacers disposed along the at least one peripheral edge of the base panel at the rear side thereof; and wherein each vertical slot is spaced a predetermined distance from each other vertical slot.

13. An organization system supported on a horizontal surface, comprising:

a base panel having a front side, a rear side, and at least one peripheral edge, the base panel further including a plurality of parallel vertical slots, each slot having through portions traversing completely through the base panel from the front side to the rear side, the through portions alternating with blocked portions cut partially through the base panel from the front side, the through portions of each slot mutually co-aligned and the blocked portions of each slot mutually co-aligned, the base panel including a stand fixed with the bottom side for supporting the base panel in an upright position on the horizontal surface;

a plurality of supports each having two opposing sides, a top end, a bottom end, a front end, a rear end terminating at an upper hook and a lower hook, the support having a thickness between the two opposing sides less than a thickness of each vertical slot of the base panel, the upper hook and lower hook configured to cooperate with the through portions and the blocked portions of the vertical slot to traverse the through portions and hook around the blocked portions to support a load on the top end of the support;

whereby with the base panel supported upright on the horizontal surface, each support is tilted rearward so that the upper hook traverses one of the vertical slots at the through portion and then rotated forward and slid downwardly in the slot so that both the upper hook and the lower hook engage one of the blocked portions of the slot to firmly seat the support within the slot, the load then rested on the top surface of the support.

14. The organization system of claim 13 wherein the load includes a shelf supported by two of the supports, each of the supports being engaged with two separate of the vertical slots.

15. The organization system of claim 13 wherein the load includes a clothes bar supported by two of the supports, each of the supports being engaged with two separate of the vertical slots.

16. The organization system of claim 13 wherein the load includes a dual shelf rack supported by two of the supports, each of the supports being engaged with two separate of the vertical slots.

17. The organization system of claim 13 further including a metallic strip fixed with the rear side of the base panel at each blocked portion of each slot, such that when the supports are fully engaged with the slots, at least the upper hook of each support contacts the metallic strip.

18. The organization system of claim 13 wherein each vertical slot is spaced a predetermined distance from each other vertical slot.

* * * * *